US011282437B2

(12) United States Patent
Yin

(10) Patent No.: US 11,282,437 B2
(45) Date of Patent: Mar. 22, 2022

(54) PIXEL CIRCUIT AND DRIVING METHOD THEREOF, AND DISPLAY DEVICE

(71) Applicant: BOE TECHNOLOGY GROUP CO., LTD., Beijing (CN)

(72) Inventor: Xinshe Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/767,427

(22) PCT Filed: Mar. 13, 2019

(86) PCT No.: PCT/CN2019/077914
§ 371 (c)(1),
(2) Date: May 27, 2020

(87) PCT Pub. No.: WO2020/181512
PCT Pub. Date: Sep. 17, 2020

(65) Prior Publication Data
US 2021/0201761 A1 Jul. 1, 2021

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2310/0278* (2013.01); *G09G 2310/063* (2013.01); *G09G 2330/028* (2013.01)

(58) Field of Classification Search
None
See application file for complete search history.

(56) References Cited

U.S. PATENT DOCUMENTS 10,102,803 B2 10/2018 Park et al.
2002/0195964 A1* 12/2002 Yumoto ..... G09G 3/3241 315/169.3
2008/0198102 A1 8/2008 Yamashita et al.
2008/0231562 A1 9/2008 Kwon
2010/0188320 A1* 7/2010 Min ..... G09G 3/3291 345/80

(Continued)

FOREIGN PATENT DOCUMENTS

CN 101251976 A 8/2008
CN 102568373 A 7/2012

(Continued)

*Primary Examiner* — Chad M Dicke
(74) *Attorney, Agent, or Firm* — The Webb Law Firm

(57) ABSTRACT

The present disclosure provides a pixel circuit and a driving method thereof, and a display device. The pixel circuit includes: a light emitting element including an anode and a cathode electrically connected to a first voltage terminal; a control circuit; a first switching circuit configured to transmit a voltage from a data line; a driving circuit including: a first transistor, of which a control terminal, a first terminal and a second terminal are electrically connected to the first switching circuit, a second voltage terminal, and the control circuit respectively, and a capacitor, of which a first terminal and a second terminal are electrically connected to the second voltage terminal and the first switching circuit respectively; and a second switching circuit configured to be in a conductive state to stabilize a potential of the data line at a first fixed level or a second fixed level.

9 Claims, 6 Drawing Sheets

(56) References Cited

U.S. PATENT DOCUMENTS

| | | | | |
|---|---|---|---|---|
| 2013/0221856 | A1 | 8/2013 | Soto | |
| 2017/0025061 | A1 | 1/2017 | Takizawa et al. | |
| 2017/0206836 | A1* | 7/2017 | Kim | G09G 3/3233 |
| 2017/0249904 | A1 | 8/2017 | Li et al. | |

FOREIGN PATENT DOCUMENTS

| | | | |
|---|---|---|---|
| CN | 106652907 | A | 5/2017 |
| JP | 2003186439 | A | 7/2003 |

* cited by examiner

PIXEL CIRCUIT AND DRIVING METHOD THEREOF, AND DISPLAY DEVICE

CROSS-REFERENCE TO RELATED APPLICATION

This application is the United States national phase of International Application No. PCT/CN2019/077914 filed Mar. 13, 2019, the disclosure of which is hereby incorporated by reference in its entirety.

TECHNICAL FIELD

The present disclosure relates to a pixel circuit and a driving method thereof, and a display device.

BACKGROUND

Due to the manufacturing process or the properties of a driving transistor itself, driving transistors indifferent pixels of the OLED (Organic Light Emitting Diode) display panel may have different threshold voltages at a same time. In addition, the driving transistor in a same pixel may also have different threshold voltages at different times. That is, there is a drift phenomenon in the threshold voltage of the driving transistor.

Therefore, even under a same gray scale, since the driving transistors have different threshold voltages, the driving currents for driving OLEDs in different pixels will also be different. This results in different display brightness of different pixels, thereby causing uneven display brightness of the display panel.

SUMMARY

According to one aspect of the embodiments of the present disclosure, a pixel circuit is provided. The pixel circuit comprises: a light emitting element comprising an anode and a cathode that is electrically connected to a first voltage terminal; a control circuit electrically connected to the anode of the light emitting element and configured to be turned on or off in response to a control signal from a control line; a first switching circuit configured to be in a conductive state, in response to a first scan signal from a first scan line, to transmit a voltage from a data line; a driving circuit configured to drive the light emitting element to emit light under control of the voltage transmitted from the first switching circuit, the driving circuit comprising: a first transistor, of which a control terminal is electrically connected to the first switching circuit, a first terminal is electrically connected to a second voltage terminal, and a second terminal is electrically connected to the control circuit, and a capacitor, of which a first terminal is electrically connected to the second voltage terminal, and a second terminal is electrically connected to the first switching circuit; and a second switching circuit electrically connected to the data line, the second terminal of the first transistor and the control circuit, and configured to be in a conductive state, in response to a second scan signal from a second scan line, to stabilize a potential of the data line at a first fixed potential or a second fixed potential, wherein the first fixed potential makes the light emitting element emit light, and the second fixed potential makes the first transistor be turned off.

In some embodiments, the second switching circuit comprises a second transistor, of which a control terminal is configured to receive the second scan signal, a first terminal is electrically connected to the data line, and a second terminal is electrically connected to the control circuit.

In some embodiments, the data line is electrically connected to a reset circuit, and the potential of the data line is reset by the reset circuit to a first initial potential or a second initial potential, wherein the first initial potential makes the light emitting element not emit light, and the second initial potential makes the first transistor be turned on.

In some embodiments, the control circuit comprises a fourth transistor, of which a control terminal is configured to receive the control signal, a first terminal is electrically connected to the second terminal of the first transistor, and a second terminal is electrically connected to the anode of the light emitting element.

In some embodiments, the first switching circuit comprises a third transistor, of which a control terminal is configured to receive the first scan signal, a first terminal is electrically connected to the data line, and a second terminal is electrically connected to the second terminal of the capacitor and the control terminal of the first transistor.

According to another aspect of the embodiments of the present disclosure, a display device is provided. The display device comprises a plurality of pixel units each of which comprising the pixel circuit according to any one of the above embodiments.

In some embodiments, the display device further comprises: a plurality of control lines, each of which is electrically connected to the control circuit of the pixel circuit in each of a same row of pixel units of the plurality of pixel units; a plurality of first scan lines, each of which is electrically connected to the first switching circuit of the pixel circuit in each of a same row of pixel units of the plurality of pixel units; a plurality of second scan lines, each of which is electrically connected to the second switching circuit of the pixel circuit in each of the same row of pixel units of the plurality of pixel units; and a plurality of data lines, each of which is electrically connected to the first switching circuit and the second switching circuit of the pixel circuit in each of a same column of pixel units of the plurality of pixel units.

In some embodiments, the display device further comprises: a plurality of reset circuits disposed in a non-display area or a source driver of the display device, wherein each of the plurality of reset circuits is electrically connected to a corresponding data line of the plurality of data lines, and configured to reset the potential of the corresponding data line to a first initial potential or a second initial potential in response to a reset signal, wherein the first initial potential makes the light emitting element in each of the same column of pixel units electrically connected to the corresponding data line not emit light, and the second initial potential makes the first transistor in each of the same column of pixel units electrically connected to the corresponding data line be turned on.

In some embodiments, each of the plurality of reset circuits comprises a fifth transistor, of which a control terminal is configured to receive the reset signal, a first terminal is electrically connected to the corresponding data line, and a second terminal is electrically connected to a third voltage terminal.

According to still another aspect of the embodiments of the present disclosure, a driving method of the pixel circuit according to any one of the above embodiments is provided. The driving method comprises: stabilizing, in a first stage, the potential of the data line at the first fixed potential that makes the light emitting element emit light; stabilizing, in a second stage, the potential of the data line at the second fixed potential that makes the first transistor be turned off; and providing, in a display stage, a compensated data voltage to the data line to drive the light emitting element to emit light, wherein the compensated data voltage is determined according to the first fixed potential and the second fixed potential, wherein the first stage and the second stage are in a non-display stage.

In some embodiments, the first stage comprises a first non-display stage and a second non-display stage after the first non-display stage; in the first non-display stage, the control circuit is turned on in response to the control signal, the first switching circuit is turned on in response to the first scan signal from the first scan line to transmit a sensing voltage from the data line to the second end of the capacitor and the control terminal of the first transistor, the first transistor is turned on under control of the sensing voltage to generate a sensing current, and the second switching circuit is turned off in response to the second scan signal from the second scan line; and in the second non-display stage, the control circuit is turned on in response to the control signal, the first switching circuit is turned off in response to the first scan signal, and the second switching circuit is turned on in response to the second scan signal to charge the data line by the sensing current, thereby stabilizing the potential of the data line at the first fixed potential.

In some embodiments, the sensing voltage is a sum of an initial voltage and a first compensation voltage, wherein the initial voltage is configured to make the first transistor generate the sensing current, the first compensation voltage is determined according to a threshold voltage of the first transistor, and the threshold voltage of the first transistor is determined according to the second fixed level.

In some embodiments, the second stage comprises a third non-display stage; in the third non-display stage, the control circuit is turned off in response to the control signal, the second switching circuit is turned on in response to the second scan signal to charge the data line, and the first switching circuit is turned on in response to the first scan signal to charge the capacitor by the data line, thereby stabilizing the potential of the data line at the second fixed potential.

In some embodiments, the first stage further comprises a fourth non-display stage between the first non-display stage and the second non-display stage; in the fourth non-display stage, the potential of the data line is reset to a first initial potential that makes the light emitting element not emit light, the control circuit is turned on in response to the control signal, the first switching circuit is turned off in response to the first scan signal, and the second switching circuit is turned on in response to the second scan signal.

In some embodiments, the second stage further comprises a fifth non-display stage before the third non-display stage; in the fifth non-display stage, the potential of the data line is reset to a second initial potential that makes the first transistor be turned on, the control circuit is turned off in response to the control signal, the first switching circuit is turned on in response to the first scan signal, and the second switching circuit is turned on in response to the second scan signal.

In some embodiments, the first stage further comprises a sixth non-display stage after the second non-display stage; in the sixth non-display stage, the first fixed potential is read by a source driver from the data line.

In some embodiments, the second stage further comprises a seventh non-display stage after the third non-display stage; in the seventh non-display stage, the first fixed potential is read by a source driver from the data line.

In some embodiments, a display cycle is a time period between a startup time of a display panel where the pixel circuit is located and a shutdown time of the display panel; during a same display cycle, the first stage is between the startup time of the display panel and a start time of the display stage, and the second stage is between an end time of the display stage and the shutdown time of the display panel.

In some embodiments, in the display stage, the control circuit is turned on in response to the control signal, the first switching circuit is turned on in response to the first scan signal to transmit the compensated data voltage from the data line to the second terminal of the capacitor and the control terminal of the first transistor, the first transistor is turned on under control of the compensated data voltage to generate a driving current for driving the light emitting element to emit light, and the second switching circuit is turned off in response to the second scan signal; and wherein the compensated data voltage is a sum of a data voltage before compensation, a first compensation voltage, and a second compensation voltage, wherein the first compensation voltage is determined according to a threshold voltage of the first transistor, the second compensation voltage is determined according to an operating voltage of the light emitting element, the threshold voltage of the first transistor is determined according to the second fixed potential of a previous display cycle of a current display cycle, and the operating voltage of the light emitting element is determined according to the first fixed potential of the current display cycle.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description with reference to the accompanying drawings, in which.

Figure 1:
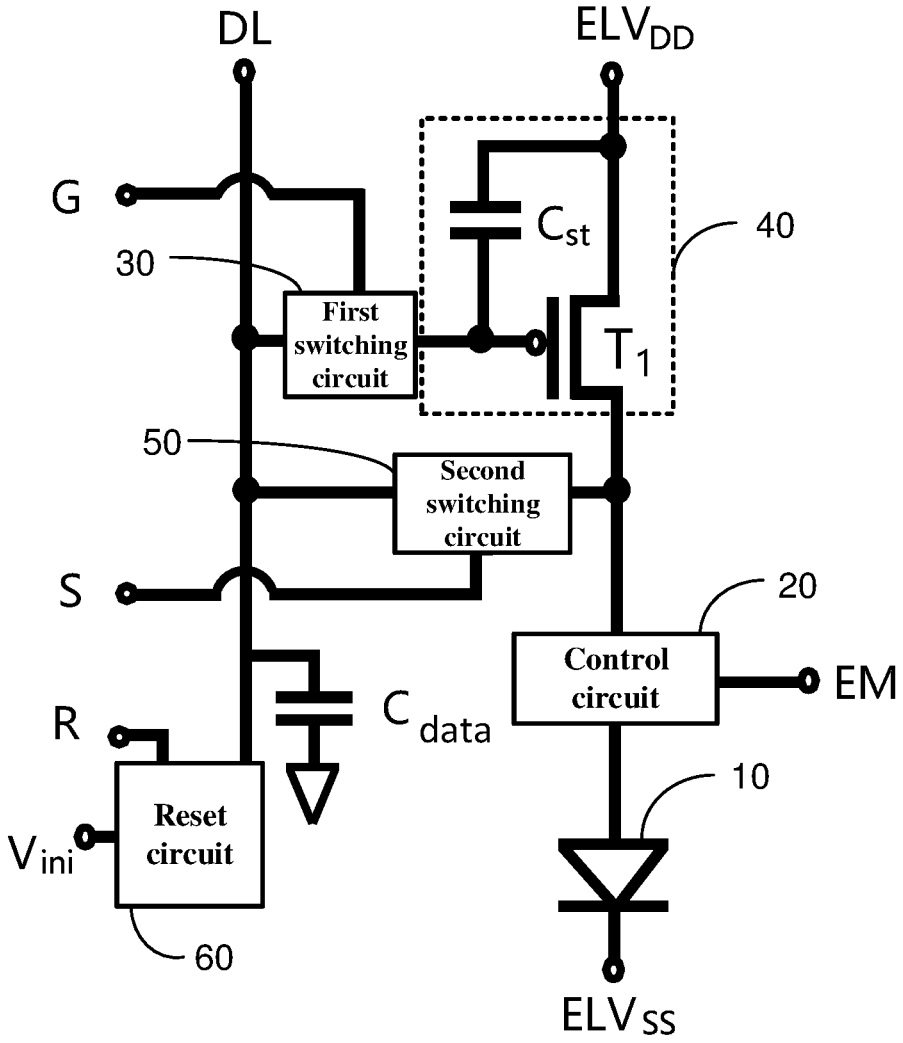
FIG. 1 is a schematic structural view showing a pixel circuit according to an embodiment of the present disclosure.

It should be understood that the dimensions of the various parts shown in the accompanying drawings are not necessarily drawn according to the actual scale. In addition, the same or similar reference signs are used to denote the same or similar components.

DETAILED DESCRIPTION

Various exemplary embodiments of the present disclosure will now be described in detail with reference to the accompanying drawings. The following description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "have" or variants thereof means that the element before the word covers the element (s) listed after the word without excluding the possibility of also covering other elements. The terms "up", "down", or the like are used only to represent a relative positional relationship, and the relative positional relationship may be changed correspondingly if the absolute position of the described object changes.

In the present disclosure, when it is described that a specific component is disposed between a first component and a second component, there may be an intervening component between the specific component and the first component or between the specific component and the second component. When it is described that a specific part is connected to other parts, the specific part may be directly connected to the other parts without an intervening part, or not directly connected to the other parts with an intervening part.

Unless otherwise defined, all terms (including technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventor has noticed that the luminous efficiency of alight emitting element in a pixel will be reduced with increasing of operation time, which results in decreasing display brightness of the pixel. For example, pixels in a certain area emitting light for a longer time or with a higher brightness than pixels in other areas are more likely to have a reduced luminous efficiency, and thus have a relatively low display brightness, which results in uneven display brightness and an afterimage phenomenon.

FIG. 1 is a schematic structural view showing a pixel circuit according to an embodiment of the present disclosure.

As shown in FIG. 1, the pixel circuit comprises a light emitting element 10, a control circuit 20, a first switching circuit 30, a driving circuit 40 and a second switching circuit 50.

The light emitting element 10 comprises an anode and a cathode that is electrically connected to a first voltage terminal $ELV_{SS}$. In some embodiments, the light emitting element 10 may be, for example, OLED or the like.

The control circuit 20 is electrically connected to the anode of the light emitting element 10. The control circuit 20 is configured to be turned on or off in response to the control signal EM.

The first switching circuit 30 is electrically connected between a data line DL and the drive circuit 40. The first switching circuit 30 is configured to be in a conductive state, in response to a first scan signal G from a first scan line, to transmit a voltage from the data line DL to the driving circuit 30.

The driving circuit 40 is configured to drive the light emitting element 10 to emit light under control of the voltage transmitted from the first switching circuit 20. Referring to FIG. 1, the driving circuit 40 comprises a first transistor T1 and a capacitor $C_{at}$. The control terminal of the first transistor T1 is electrically connected to the first switching circuit 30, the first terminal of the first transistor T1 is electrically connected to the second voltage terminal $ELV_{DD}$, and the second terminal of the first transistor T1 is electrically connected to the control circuit 20. The first terminal of the capacitor $C_{at}$ is electrically connected to the second voltage terminal $ELV_{DD}$, and the second terminal of the capacitor $C_{at}$ is electrically connected to the first switching circuit 30 and the control terminal of the first transistor T1. Here, the level of the second voltage terminal $ELV_{DD}$ is higher than the level of the first voltage terminal $ELV_{SS}$. For example, the second voltage terminal $ELV_{DD}$ is a power supply voltage terminal, and the first voltage terminal $ELV_{SS}$ is a ground terminal.

The second switching circuit 50 is electrically connected to the data line DL, the second terminal of the first transistor T1, and the control circuit 20. The second switching circuit 50 is configured to be in a conductive state, in response to a second scan signal S from a second scan line, to stabilize the potential of the data line DL at a first fixed potential or a second fixed potential. Here, the first fixed potential makes the light emitting element 10 emit light, and the second fixed potential makes the first transistor T1 be turned off. The potential of the data line DL may be stabilized at the first fixed potential or the second fixed potential in different stages, which will be described later in conjunction with the driving method.

It should be understood that the first fixed potential is a sum of the potential of the cathode of the light emitting element 10 (i.e., the potential of the first voltage terminal $ELV_{SS}$) and the operating voltage $V_{OLED}$ of the light emitting element 10. Therefore, after the potential of the data line DL is stabilized at the first fixed potential, the first fixed potential of the data line DL can be read and then the operating voltage $V_{OLED}$ of the light emitting element 10 can be obtained. For example, a source driver that provides the data voltage may read the first fixed potential of the data line DL and store the operating voltage $V_{OLED}$ of the light emitting element 10.

In a display stage, the data voltage $V_{data}$ which is the sum of an original data voltage $V_{pixel}$ and a second compensation voltage $f2(V_{OLED})$ may be provided by the source driver to the data line DL to compensate the luminous efficiency of the light emitting element 10. Here, the second compensation voltage $f2(V_{OLED})$ is determined according to the operating voltage $V_{OLED}$ of the light emitting element 10. It should be understood that the luminous efficiency corresponding to the operating voltage $V_{OLED}$ of the light emitting element 10 may be determined by a compensation model between the operating voltage and the luminous efficiency of the light emitting element, and then the compensation voltage, i.e. the second compensation voltage $f2(V_{OLED})$, required to compensate reduced luminous efficiency of the light emitting element 10 may be determined.

It should be also understood that the second fixed potential is the sum of the potential of the second voltage terminal $ELV_{DD}$ and the threshold voltage $V_{TH}$ of the first transistor T1. Therefore, after the potential of the data line DL is stabilized at the second fixed potential, the second fixed potential of the data line DL may be read, and then the threshold voltage $V_{TH}$ of the first transistor T1 may be obtained. For example, the source driver that provides the data voltage may read the second fixed potential of the data line DL and store the threshold voltage $V_{TH}$ of the first transistor T1.

In the display stage, the data voltage $V_{data}$ which is the sum of the original data voltage $V_{pixel}$ and a first compensation voltage $f1(V_{TH})$ may be provided by the source driver to the data line DL to compensate the threshold voltage $V_{TH}$ of the first transistor T1. Thus, the problem of uneven display brightness resulting from the difference in the threshold voltages $V_{TH}$ of the first transistor T1 will be alleviated. Here, the first compensation voltage $f1(V_{TH})$ is determined according to the threshold voltage $V_{TH}$ of the first transistor T1.

For example, the first compensation voltage $f1(V_{TH})$ may be equal to the threshold voltage $V_{TH}$. For another example, the first compensation voltage $f1(V_{TH})$ may be a sum or a difference between the threshold voltage $V_{TH}$ and another value. Here, this another value may be, for example, an average value of the threshold voltages $V_{TH}$ of the first transistors T1 in different pixels.

In some embodiments, the control signal EM may be a pulse width modulation (PWM) signal. In the display stage, the brightness of the pixel may be adjusted by adjusting the duty cycle of the PWM signal.

In the above embodiments, in a case where the second switching circuit is turned on, the potential of the data line can be stabilized at the first fixed potential or the second fixed potential. The operating voltage of the light emitting element may be obtained according to the first fixed potential, and the threshold voltage of the first transistor may be obtained according to the second fixed potential. Furthermore, the luminous efficiency of the light emitting element and the threshold voltage of the first transistor may be compensated in an external compensation manner so as to alleviate the problem of uneven display brightness resulting from the reduce in the luminous efficiency of the light emitting element and the difference in the threshold voltages of the first transistors.

In some embodiments, as shown in FIG. 1, the data line DL may be electrically connected to a reset circuit 60. The potential of the data line DL is reset to a first initial potential $V_{ini1}$ or a second initial potential $V_{ini2}$ by the reset circuit 60. The first initial potential $V_{ini1}$ makes the light emitting element 10 not emit light, and the second initial potential $V_{ini2}$ makes the first transistor T1 be turned on. It should be understood that, the difference between the first initial potential $V_{ini1}$ and the potential of the cathode of the light emitting element 10 is smaller than the operating voltage $V_{OLED}$ of the light emitting element 10, so the light emitting element 10 will not emit light. In some embodiments, the first initial potential $V_{ini1}$ and the second initial potential $V_{ini2}$ may be the same. In other embodiments, the first initial potential $V_{ini1}$ and the second initial potential $V_{ini2}$ may be different.

In the above embodiments, before being stabilized at the first fixed potential that makes the light emitting element emit light, the potential of the data line may be reset to the first initial potential that makes the light emitting element not emit light. In addition, before being stabilized at the second fixed potential that makes the first transistor be turned off, the potential of the data line may be reset to the second initial potential that makes the first transistor be turned on. In this way, the influence of the potential fluctuation over the first fixed potential before the potential of the data line is stabilized at the first fixed potential may be reduced and the first fixed potential is more accurate. Thus, the operating voltage $V_{OLED}$ of the light emitting element finally obtained is more accurate. In addition, the influence of the potential fluctuation over the second fixed potential before the potential of the data line is stabilized at the second fixed potential may be also reduced and the second fixed potential is more accurate. Thus, the threshold voltage $V_{TH}$ of the first transistor finally obtained is more accurate.

Figure 2:
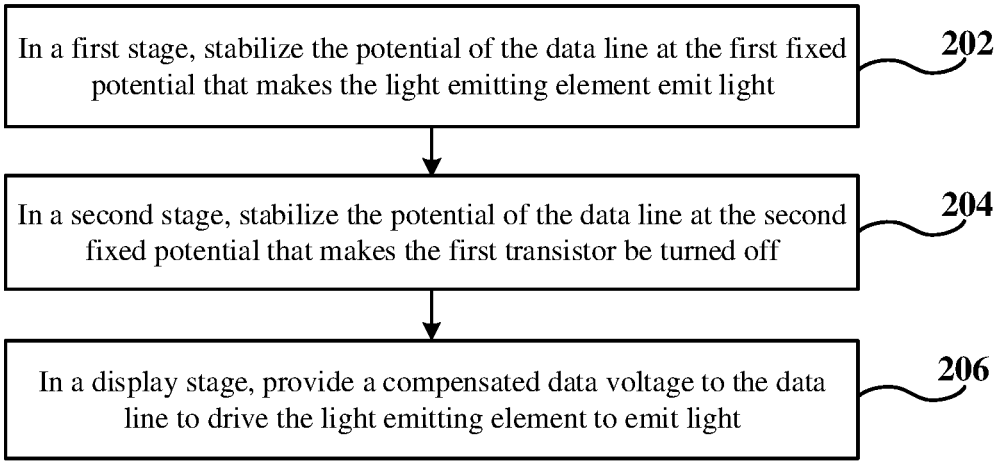
FIG. 2 is a schematic flowchart showing a driving method of a pixel circuit according to an embodiment of the present disclosure.
Figure 3:
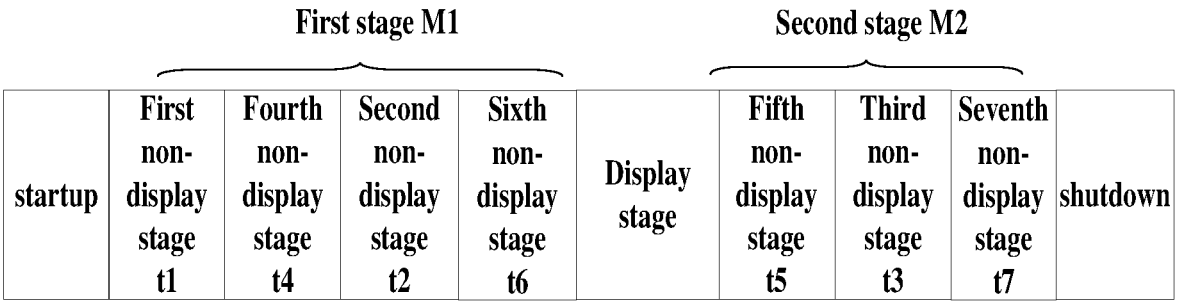
FIG. 3 is a schematic view showing a display cycle according to an embodiment of the present disclosure.

FIG. 2 is a schematic flowchart showing a driving method of a pixel circuit according to an embodiment of the present disclosure. FIG. 3 is a schematic view showing a display cycle according to an embodiment of the present disclosure. In FIG. 3, a display cycle is a time period between a startup time of the display panel where the pixel circuit is located and the shutdown time of the display panel.

The driving method of the pixel circuit will be described below in conjunction with FIGS. 2 and 3.

At step 202, in the first stage M1, the potential of the data line DL is stabilized at a first fixed potential that makes the light emitting element 10 emit light.

In some embodiments, referring to FIG. 3, the first stage M1 may be between the startup time of the display panel and the start time of the display stage (i.e., the time when the display panel starts to display a screen). Before the display stage, the light emitting element 10 does not emit light, and the operating voltage of the light emitting element 10 is less affected by the junction temperature of the light emitting element 10. At this time, the first fixed potential obtained is more accurate, and the operating voltage $V_{OLED}$ of the light emitting element 10 finally obtained is more accurate.

At step 204, in the second stage M2, the potential of the data line DL is stabilized at a second fixed potential that makes the first transistor T1 be turned off.

In some embodiments, the second stage M2 may be between the end time of the display stage (i.e., the time when the display panel stops displaying a display screen) and the shutdown time of the display panel. Since the display stage has past, the junction temperature of the first transistor T1 is at a stable state, thus the influence over the threshold voltage $V_{TH}$ resulting from the junction temperature of the first transistor T1 is reduced. In this case, the second fixed potential obtained is more accurate, and the threshold voltage $V_{TH}$ obtained is closer to the threshold voltage during operation of the first transistor T1 and thus is more accurate.

It should be understood that the display cycle shown in FIG. 3 is only an example. In some embodiments, during a same display cycle, the first stage M1 and the second stage M2 may be both between the startup time of the display panel and the start time of the display stage, or may be both between the end time of the display stage and the shutdown time of the display panel.

At step 206, in the display stage, a compensated data voltage is provided to the data line DL to drive the light emitting element 10 to emit light. Here, the compensated data voltage is determined according to the first fixed potential and the second fixed potential.

In some embodiments, in the display phase, the control circuit 20 is turned on in response to the control signal EM, the first switching circuit 20 is turned on in response to the first scan signal G to transmit the compensated data voltage from the data line DL to the second terminal of the capacitor $C_{st}$ and the control terminal of the first transistor T1. The first transistor T1 is turned on under control of the compensated data voltage to generate a driving current for driving the light emitting element 10 to emit light. In addition, in the display stage, the second switching circuit 40 is turned off in response to the second scan signal S.

Here, the compensated data voltage is the sum of a data voltage before compensation (also referred to as the original data voltage $V_{pixel}$), the first compensation voltage $f1(V_{TH})$, and the second compensation voltage $f2(V_{OLED})$. The first compensation voltage $f1(V_{TH})$ is determined according to the threshold voltage $V_{TH}$ of the first transistor T1. The second compensation voltage f2 ($V_{OLED}$) is determined according to the operating voltage $V_{OLED}$ of the light emitting element 10. In some embodiments, the operating voltage of the light emitting element 10 may be determined according to the first fixed potential V1 of a current display cycle, and the threshold voltage $V_{TH}$ of the first transistor T1 may be determined according to the second fixed potential V2 of a previous display cycle of the current display cycle.

In this case, the compensated data voltage may compensate the luminous efficiency of the light emitting element 10 and the threshold voltage $V_{TH}$ of the first transistor T1 so as to alleviate the problem of uneven display brightness resulting from a reduce in the luminous efficiency of the light emitting element 10 and a difference in the threshold voltages $V_{TH}$ of the first transistor T1.

The first stage M1 according to different embodiments of the present disclosure will be introduced below in conjunction with FIGS. 1 and 3.

In some embodiments, referring to FIG. 3, the first stage M1 may comprise a first non-display stage t1 and a second non-display stage t2 after the first non-display stage t1.

In the first non-display phase t1, the control circuit 20 is turned on in response to the control signal EM, the second switching circuit 50 is turned off in response to the second scan signal from the second scan line, and the first switching circuit 30 is turned on in response to the first scan signal G from the first scan line. In this case, a sensing voltage from the data line DL is transmitted to the second terminal of the capacitor $C_{st}$ and the control terminal of the first transistor T1. The first transistor T1 is turned on under control of the sensing voltage to generate a sensing current.

In some implementations, the sensing voltage is the sum of an initial voltage and the first compensation voltage $f1(V_{TH})$. The first compensation voltage $f1(V_{TH})$ is determined according to the threshold voltage $V_{TH}$ of the first transistor T1. In other words, the sensing voltage received by the driving circuit 30 in the first non-display stage t1 is a voltage obtained by compensating the threshold voltage of the first transistor T1, so that the sensing current generated by the first transistor T1 is a constant sensing current. Here, the initial voltage is configured such that the first transistor T1 generates a sensing current. The initial voltage may be set according to actual conditions. For example, the value of the initial voltage may be set according to the sensing current desired to be obtained.

In the second non-display phase t2, the control circuit 20 is turned on in response to the control signal EM, the first switching circuit 30 is turned off in response to the first scan signal G, and the second switching circuit 50 is turned on in response to the second scan signal so that the sensing current charges the data line DL, so that the level on the data line DL is stabilized at the first fixed level.

In other embodiments, referring to FIG. 3, the first stage M1 may further comprise a fourth non-display stage t4 between the first non-display stage t1 and the second non-display stage t2. In the fourth non-display stage t4, the potential of the data line DL is reset to a first initial potential that makes the light emitting element 10 not emit light. In the fourth non-display stage t4, the control circuit 20 is turned on in response to the control signal EM, the first switching circuit 30 is turned off in response to the first scan signal G, and the second switching circuit 50 is turned on in response to the second scan signal S.

In the above embodiments, before being stabilized at the first fixed potential that makes the light emitting element 10 emit light in the second non-display stage t2, the potential of the data line DL is first reset to the first initial potential that makes the light emitting element 10 not emit light in the fourth non-display stage t4. In this way, the influence of the potential fluctuation over the first fixed potential before the potential of the data line DL is stabilized at the first fixed potential is reduced. Thus, the first fixed potential is more accurate and the operating voltage $V_{OLED}$ of the light emitting element finally obtained is more accurate.

Instill other embodiments, referring to FIG. 3, the first stage M1 further comprises a sixth non-display stage t6 after the second non-display stage t2. In the sixth non-display stage t6, the first fixed potential is read by the source driver from the data line DL.

The second stage M2 according to different embodiments of the present disclosure will be described below in conjunction with FIG. 3.

In some embodiments, referring to FIG. 3, the second stage M2 may comprise a third non-display stage t3.

In the third non-display stage t3, the control circuit 20 is turned off in response to the control signal EM, the second switching circuit 40 is turned on in response to the second scan signal S to charge the data line DL. In addition, the first switching circuit 20 is turned on in response to the first scan signal G to charge the capacitor by the data line DL, thereby stabilizing the potential of the data line DL at the second fixed potential that makes the first transistor T1 be turned off.

In other embodiments, referring to FIG. 3, the second stage M2 may further comprise a fifth non-display stage t5 before the third non-display stage t3. In the fifth non-display stage t5, the potential of the data line DL is reset to a second initial potential that makes the first transistor T1 in the driving circuit be turned on. Here, in the fifth non-display stage t5, the control circuit 20 is turned off in response to the control signal EM, the first switching circuit 20 is turned on in response to the first scan signal G, and the second switching circuit 40 is turned on in response to the second scan signal S.

In the above embodiments, before being stabilized at the second fixed potential that makes the first transistor T1 be turned off, the potential of the data line DL is first reset to the second initial potential that makes the first transistor T1 be turned on. In this way, the influence of the potential fluctuation over the second fixed potential before the potential of the data line DL is stabilized at the second fixed potential is reduced. Thus, the second fixed potential is more accurate, and the threshold value $V_{TH}$ of the first transistor T1 finally obtained is more accurate.

In still other embodiments, referring to FIG. 3, the second stage M2 may further comprise a seventh non-display stage t7 after the third non-display stage t3. In the seventh non-display stage t7, the second fixed potential is read by the source driver from the data line DL.

Figure 4:
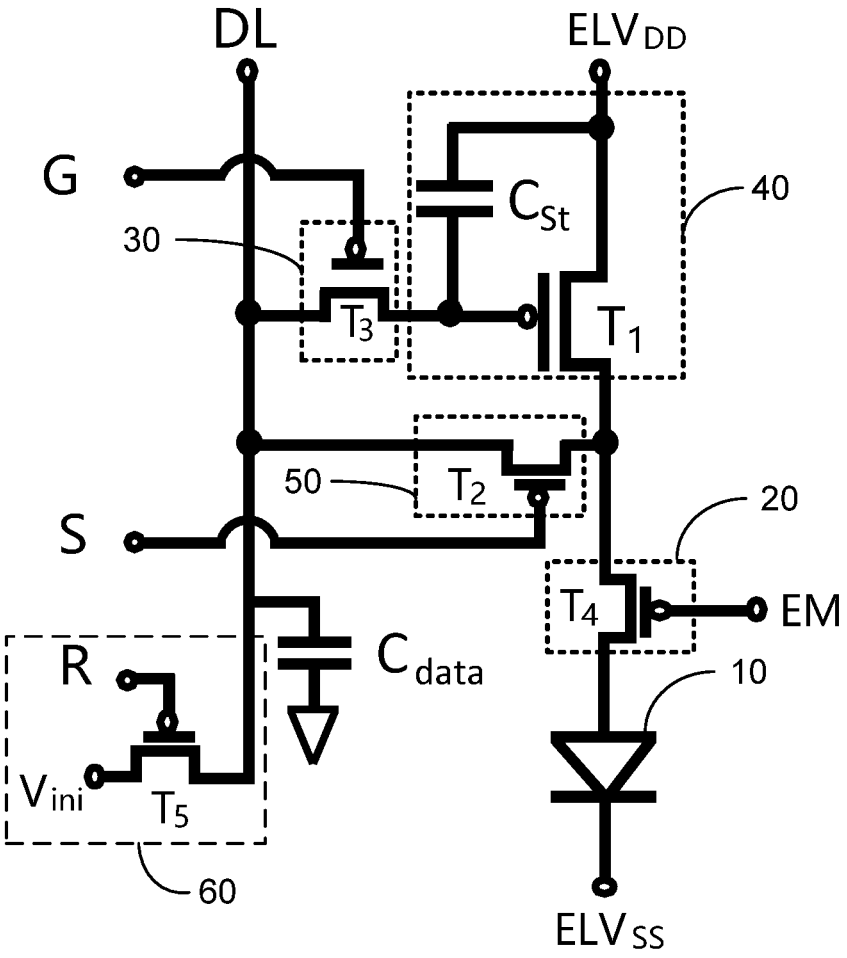
FIG. 4 is a schematic structural view showing a pixel circuit according to another embodiment of the present disclosure.

FIG. 4 is a schematic structural view showing a pixel circuit according to another embodiment of the present disclosure. The specific implementations of various circuits in the pixel circuit and the reset circuit will be described below in conjunction with FIG. 4. It should be understood that although the pixel circuit in FIG. 4 shows a specific implementation of each circuit, in some embodiments, one or more circuits are not limited to the implementation shown in FIG. 4.

In some implementations, the second switching circuit 50 comprises a second transistor T2. The control terminal of the second transistor T2 is configured to receive the second scan signal S, the first terminal of the second transistor T2 is electrically connected to the data line DL, and the second terminal of the second transistor T2 is electrically connected to the control circuit 20.

In some implementations, the first switching circuit 30 comprises a third transistor T3. The control terminal of the third transistor T3 is configured to receive the first scan signal G, the first terminal of the third transistor T3 is electrically connected to the data line DL, the second terminal of the third transistor T3 is electrically connected to the second terminal of the capacitor $C_{st}$ and the control terminal of the first transistor T1.

In some implementations, the control circuit 20 comprises a fourth transistor T4. The control terminal of the fourth transistor T4 is configured to receive the control signal EM, the first terminal of the fourth transistor T4 is electrically connected to the second terminal of the first transistor T1 and the second terminal of the second transistor T2, and the second terminal of the fourth transistor T4 is electrically connected to the anode 10 of the light emitting element.

In some implementations, the reset circuit 60 comprises a fifth transistor T5. The control terminal of the fifth transistor T5 is configured to receive the reset signal R, the first terminal of the fifth transistor T5 is electrically connected to the data line DL, and the second terminal of the fifth transistor T5 is electrically connected to the third voltage terminal $V_{ini}$.

In the above embodiments, the pixel circuit comprises four transistors and one capacitor (i.e., 4T1C). Such a pixel circuit has a simple structure, which can not only implements sensing of the operating voltage of the light emitting element and the threshold voltage of the first transistor (i.e., driving transistor), but also helps to improve the aperture ratio of the pixel and the resolution of the display panel.

In some embodiments, each transistor in the pixel circuit in FIG. 4 may be a P-type thin film transistor (TFT). In other embodiments, the first transistor T1 in the pixel circuit shown in FIG. 4 may be a P-type TFT, some of the other transistors may be N-type TFTs, and the remaining transistors may be P-type TFTs. In some embodiments, the active layer of each transistor may comprise, but is not limited to, low temperature poly-silicon (LTPS).

The operation process of the pixel circuit shown in FIG. 4 will be described below in conjunction with FIGS. 5 to 7. In the following description, it is assumed that each transistor in the pixel circuit shown in FIG. 4 is a P-type TFT.

Figure 5:
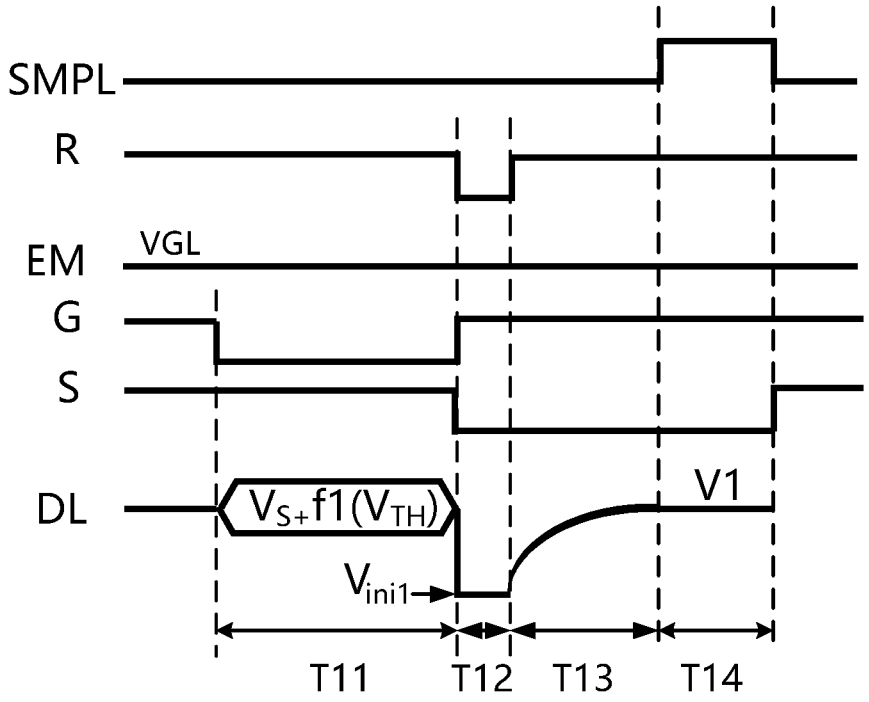
FIG. 5 is a schematic view showing timing control signals of a pixel circuit according to an embodiment of the present disclosure.

FIG. 5 is a schematic view showing timing control signals of a pixel circuit according to an embodiment of the present disclosure. The process of obtaining the operating voltage of the light emitting element 10 will be described below in conjunction with the pixel circuit shown in FIG. 4 and the timing control signals shown in FIG. 5.

As shown in FIG. 5, in the T11 stage (corresponding to the t1 stage), the first scan signal G and the control signal EM each is at a low level VGL, and the second scan signal S and the reset signal R each is at a high level VGH. Therefore, the third transistor T3 and the fourth transistor T4 are turned on, and the second transistor T2 and the fourth transistor T4 are turned off.

In addition, the sensing voltage $V_{sense}$ applied to the data line DL is transmitted to the control terminal of the first transistor T1 and the second terminal of the capacitor $C_{st}$ via the third transistor T3. The first transistor T1 is turned on under control of the sensing voltage $V_{sense}$, and a sensing current Is is generated. The sensing current Is may be presented in the following formula:

$$I_s = \frac{1}{2}\mu C_{OX}\frac{W}{L}(V_{sense} - ELV_{DD} - V_{TH})^2$$

In the above formula, p is the carrier mobility of the first transistor T1, COX is the capacitance of the gate dielectric layer of the first transistor T1, W/L is the width-to-length ratio of the channel of the first transistor T1, and $V_{TH}$ is the threshold voltage of the first transistor T1.

In some embodiments, the sensing voltage $V_{sense}$ may be the sum of the initial voltage Vs and the first compensation voltage f1($V_{TH}$). For example, the first compensation voltage f1 ($V_{TH}$) is equal to the threshold voltage $V_{TH}$ of the first transistor T1. In this case, the sensing current Is may be presented in the following formula:

$$I_s = \frac{1}{2}\mu_n C_{OX}\frac{W}{L}(ELV_{DD} - V_s)^2$$

It can be seen that the sensing current Is is not related to the threshold voltage $V_{TH}$ of the first transistor T1. In this way, the sensing current Is of the first transistors T1 in different pixel circuits will be the same.

The initial voltage Vs may be set according to actual conditions. For example, the value of the initial voltage Vs may be set according to the sensing current Is desired to be obtained. The threshold voltage $V_{TH}$ of the first transistor T1 may be obtained by, but not limited to, the method introduced later.

Next, in the T12 stage (corresponding to the t4 stage), the first scan signal G becomes to be at a high level VGH, the reset signal R and the second scan signal S each becomes to be at a low level VGL, and other signals each is at a level the same as that in the T11 stage. Therefore, the second transistor T2, the fourth transistor T4, and the fifth transistor T5 are turned on, and the third transistor T3 is turned off. In addition, since the sensing voltage $V_{sense}$ is stored in the capacitor $C_{at}$, the first transistor T1 is maintained to be in a conductive state under control of the sensing voltage $V_{sense}$ and continuously outputs the sensing current Is.

Since the fifth transistor T5 is turned on, the potential of the data line DL is reset to the first initial potential $V_{ini1}$ that makes the light emitting element 10 not emit light. It should be understood that, the value of the first initial potential $V_{ini1}$ may be set so that the difference between the first initial potential $V_{ini1}$ and the potential of the first voltage terminal $ELV_{SS}$ is smaller than the operating voltage of the light emitting element 10, and thus the light emitting element 10 will not emit light. In addition, since the light emitting element 10 does not emit light, the sensing current Is generated by the first transistor T1 will flow to the data line DL.

Next, in the T13 stage (corresponding to the t2 stage), the reset signal R becomes to be at a high level VGH, and the other signals each is at a level the same as that in the T12 stage. Therefore, the second transistor T2 and the fourth transistor T4 are turned on, and the third transistor T3 and the fifth transistor T5 are turned off. As in the T12 stage, the first transistor T1 is maintained to be in a conductive state under control of the sensing voltage $V_{sense}$, and continuously outputs the sensing current Is.

The sensing current Is output by the first transistor T1 will flow to the data line DL and charge the data line DL. It should be understood that there is a distributed capacitance $C_{data}$ between the data line DL and other lines (e.g., a data line, a scan line and the like). The potential of the data line DL starts to rise from the first initial potential $V_{ini1}$ and rises to the first fixed potential V1 after a period of time. At this time, the light emitting element 10 starts to emit light.

Next, in the T14 stage (corresponding to the t6 stage), the potential of the data line DL is stabilized at the first fixed potential V1. The first fixed potential V1 is obtained through reading the potential of the data line DL by the source driver in response to the sampling signal SMPL changing from being at a low level VGL to being at a high level VGH. It should be understood that, in some embodiments, the source driver may also read the potential of the data line DL in response to the sampling signal SMPL changing from being at a high level VGH to being at a low level VGL. After the first fixed potential V1 is obtained, the operating voltage $V_{OLED}$ of the light emitting element 10 may be obtained by calculating the difference between the first fixed potential V1 and the potential of the first voltage terminal $ELV_{SS}$.

Figure 6:
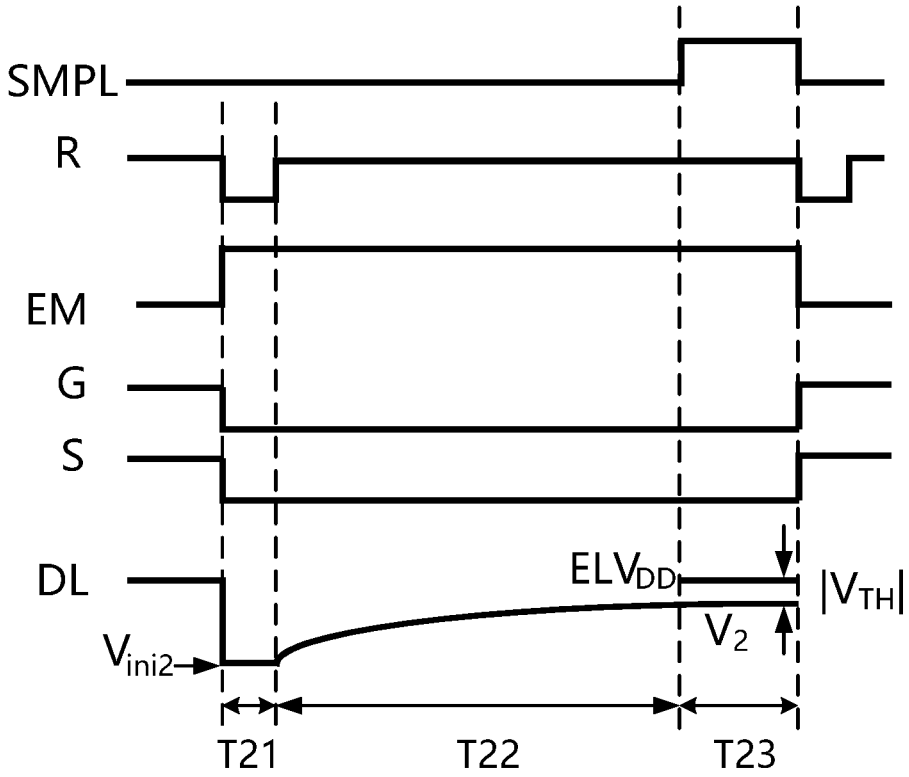
FIG. 6 is a schematic view showing timing control signals of a pixel circuit according to another embodiment of the present disclosure.

FIG. 6 is a schematic view showing timing control signals of a pixel circuit according to another embodiment of the present disclosure. The process of obtaining the threshold voltage of the first transistor T1 will be described below in conjunction with the pixel circuit shown in FIG. 4 and the timing control signals shown in FIG. 6.

As shown in FIG. 6, in the stage T21 (corresponding to the stage t5), the first scanning signal G, the second scanning signal S and the reset signal R each is at a low level VGL, and the control signal EM is at a high level VGH. Therefore, the second transistor T2, the third transistor T3, and the fifth transistor T5 are turned on, and the fourth transistor T4 is turned off.

The potential of the data line DL is reset to the second initial potential $V_{ini2}$ that makes the first transistor T1 be turned on. The second initial potential $V_{ini2}$ is written into the control terminal of the first transistor T1 and the second terminal of the capacitor $C_{st}$ via the third transistor T3. It should be understood that, the value of the second initial potential $V_{ini2}$ may be set so that the difference between the second initial potential $V_{ini2}$ and the potential of the second voltage terminal $ELV_{DD}$ is smaller than the threshold voltage $V_{TH}$ of the first transistor T1, and thus the first transistor T1 is turned on.

Next, in the T22 stage (corresponding to the t3 stage), the reset signal R becomes to be at a high level VGH, and the other signals each is at a level the same as that in the T21 stage. Therefore, the second transistor T2 and the third transistor T3 are turned on, and the fourth transistor T4 and the fifth transistor T5 are turned off.

The current output by the first transistor T1 will flow to the data line DL and charge the data line DL. The data line DL charges the capacitor $C_{st}$ through the third transistor T3. The potential of the control terminal of the first transistor T1 starts to rise from the second initial potential $V_{ini2}$ and rises to the second fixed potential V2 after a period of time. At this time, the first transistor T1 is turned off.

Next, in the T23 stage (corresponding to the t7 stage), the potential of the data line DL is stabilized at the second fixed potential V2. The absolute value of the difference between the second fixed potential V2 and the potential of the second voltage terminal $ELV_{DD}$ is equal to the absolute value $|V_{TH}|$ of the threshold voltage $V_{TH}$ of the first transistor T1. The second fixed potential V2 is obtained through reading the potential of the data line DL by the source driver in response to the sampling signal SMPL changing from being at a low level VGL to being at a high level VGH. In some embodiments, the second fixed potential V2 may be also obtained through reading the potential of the data line DL by the source driver in response to the sampling signal SMPL changing from being at a high level VGH to being at a low level VGL. After the second fixed potential V2 is obtained, the threshold voltage $V_{TH}$ of the first transistor T1 may be obtained by calculating the difference between the second fixed potential V2 and the potential of the second voltage terminal $ELV_{DD}$.

Figure 7:
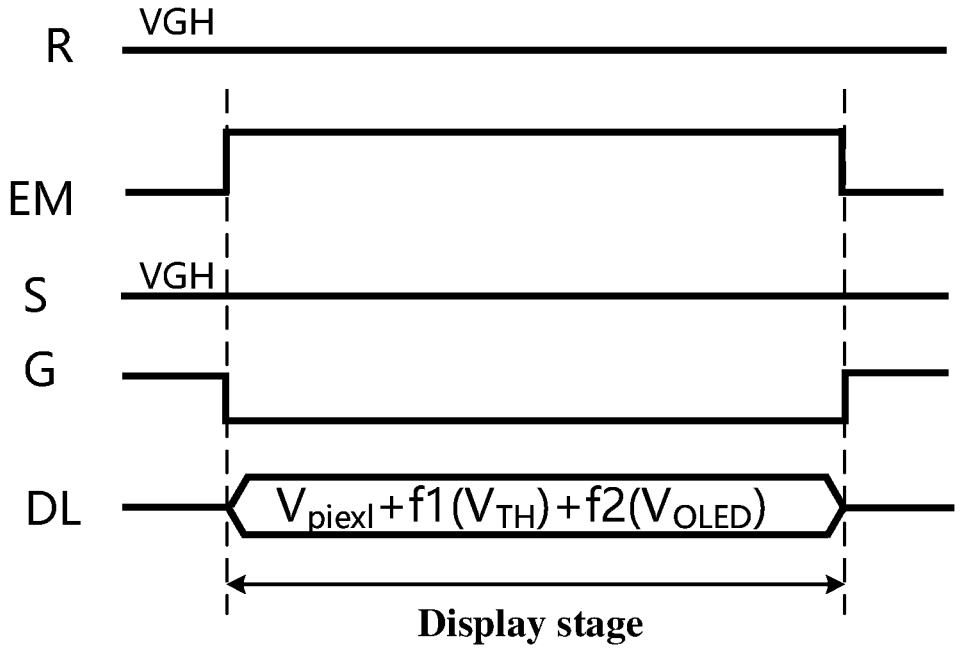
FIG. 7 is a schematic view showing timing control signals of a pixel circuit according to a further embodiment of the present disclosure.

FIG. 7 is a schematic view showing timing control signals of a pixel circuit according to a further embodiment of the present disclosure. The process of driving the pixel circuit to display will be described below in conjunction with the pixel circuit shown in FIG. 4 and the timing control signals shown in FIG. 7.

As shown in FIG. 7, in the display stage, the first scan signal G is at a low level VGL, and the second scan signal S, the reset signal R, and the control signal EM each is at a high level VGH. Therefore, the third transistor T3 is turned on, and the second transistor T2, the fourth transistor T4, and the fifth transistor T5 are turned off.

The data voltage $V_{data}$ of the data line DL is written into the control terminal of the first transistor T1 and the second terminal of the capacitor $C_{st}$ through the third transistor T3. The first transistor T1 is turned on under control of the data voltage $V_{data}$, and the light emitting element 10 is driven to emit light.

In some embodiments, the value of the data voltage $V_{data}$ may be adjusted according to the operating voltage $V_{OLED}$ of the light emitting element and the threshold voltage $V_{TH}$ of the first transistor T1 previously obtained. For example, the data voltage $V_{data}$ is the compensated data voltage, which is the sum of the original data voltage $V_{pixel}$ the first compensation voltage $f1(V_{TH})$ and the second compensation voltage $f2(V_{OLED})$, thus the problem of uneven display brightness resulting from a reduce in the luminous efficiency of the light emitting element 10 and a difference in the threshold voltages $V_{TH}$ of the first transistor T1 is alleviated. Here, the first compensation voltage $f1(V_{TH})$ is a compensation voltage related to the threshold voltage $V_{TH}$ of the first transistor T1, and the second compensation voltage $f2(V_{OLED})$ is a compensation voltage related to the operating voltage $V_{OLED}$ of the light emitting element 10.

Figure 8:
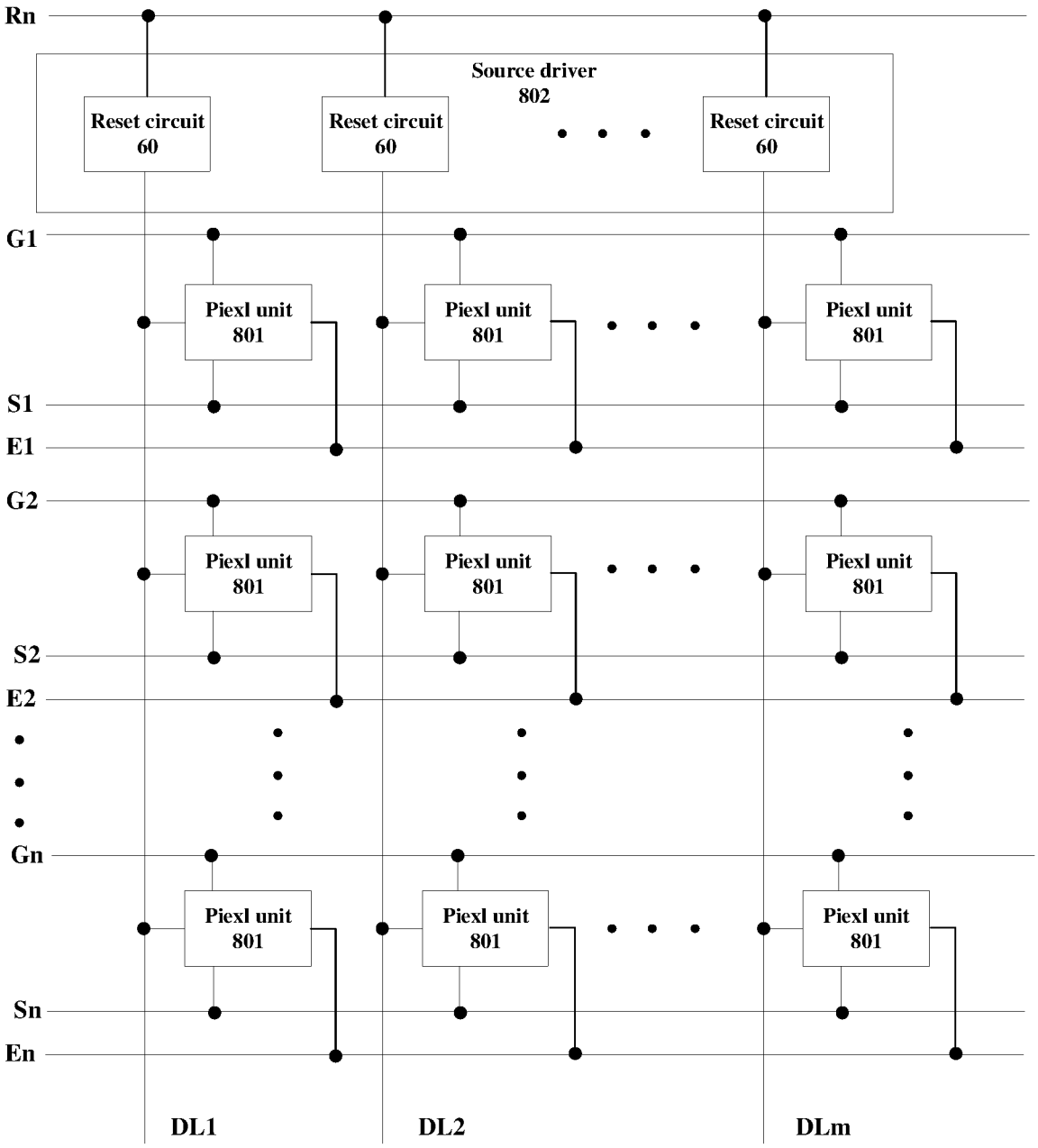
FIG. 8 is a schematic structural view showing a display device according to an embodiment of the present disclosure.

FIG. 8 is a schematic structural view showing a display device according to an embodiment of the present disclosure.

As shown in FIG. 8, the display device comprises a plurality of pixel units 801 (for example, FIG. 8 shows n (row)×m (column) pixel units 801). Each pixel unit 801 comprises the pixel circuit according to any one of the above embodiments, such as the pixel circuit shown in FIG. 1, 3, or 4. In some embodiments, the display device may be, for example, any product or member having a display function such as a display panel, a mobile terminal, a television, a display, a notebook computer, a digital photo frame, a navigator, or an electronic paper.

In some embodiments, referring to FIG. 8, the display device further comprises a plurality of control lines, for example, a control line E1, a control line E2 . . . a control line En. Each control line is electrically connected to the control circuit of the pixel circuit in each of a same row of pixel units 801. For example, the control line E1 is electrically connected to the control circuit of the pixel circuit in each of the first row of pixel units 801, the control line E2 is electrically connected to the control circuit of the pixel circuit in each of the second row of pixel units 801, and so forth.

In some embodiments, referring to FIG. 8, the display device further comprises a plurality of first scan lines, such as a first scan line G1, a first scan line G2, . . . , and a first scan line Gn. Each first scan line is electrically connected to the first switching circuit of the pixel circuit in each of a same row of pixel units 801. For example, the first scan line G1 is electrically connected to the first switching circuit of the pixel circuit in each of the first row of pixel units 801, the first scan line G2 is electrically connected to the first switching circuit of the pixel circuit in each of the second row of pixel units 801, and so forth.

In some embodiments, referring to FIG. 8, the display device further comprises a plurality of second scan lines, such as a second scan line S1, a second scan line S2, . . . , and a second scan line Sn. Each second scan line is electrically connected to the second switching circuit of the pixel circuit in each of a same row of pixel units 801. For example, the second scan line S1 is electrically connected to the second switching circuit of the pixel circuit in each of the first row of pixel units 801, the second scan line S2 is electrically connected to the second switching circuit of the pixel circuit in each of the second row of pixel units 801, and so forth.

In some embodiments, referring to FIG. 8, the display device further comprises a plurality of data lines, electrically connected to the source driver 802, for example, a data line DL1, a data line DL2, . . . , and a data line DLm. Each data line DL is electrically connected to the first switching circuit and the second switching circuit of the pixel circuit in each of a same column of pixel units 801. For example, the data line DL1 is electrically connected to the first switching circuit and the second switching circuit of the pixel circuit in each of the first column of pixel units 801, the data line DL2 is electrically connected to the first switching circuit and the second switching circuit of the pixel circuit in each of the second column of pixel units 801, and so forth.

It should be understood that the plurality of pixel units 801, the plurality of control lines, the plurality of first scan lines, the plurality of second scan lines, and the plurality of data lines are disposed in a display area of the display device. In some embodiments, the plurality of control lines, the plurality of first scan lines and the plurality of second scan lines may be electrically connected to a gate driver.

In some embodiments, referring to FIG. 8, the display device further comprises a plurality of reset circuits 60 disposed in a non-display area or the source driver 802 of the display device. For example, the plurality of reset circuits 60 is disposed in a non-display area of a display panel. For another example, the plurality of reset circuits 60 is disposed in the source driver 802 of the display device which comprises a display panel and the source driver 802. The plurality of reset circuits 60 may be electrically connected to a same reset line Rn. Each reset circuit 60 is electrically connected to a corresponding data line. That is, the plurality of reset circuits 60 are in one-to-one correspondence to the plurality of data lines. Each reset circuit 60 is configured to reset the potential of the corresponding data line to the first initial potential $V_{ini1}$ (e.g., in the fourth non-display stage t4) or the second initial potential $V_{ini2}$ (e.g., in the fifth non-display stage t5) in response to the reset signal R.

The first initial potential $V_{ini1}$ makes the light emitting element 10 in each pixel unit 801 electrically connected to the data line not emit light. For example, the potential of the data line DL1 is reset, by the reset circuit 60 electrically connected to the data line DL1, to the first initial potential $V_{ini1}$ that makes the light emitting element in each of the first column of pixel units 801 electrically connected to the data line DL1 not emit light, and the potential of the data line DL2 is reset, by the reset circuit 60 electrically connected to the data line DL2, to the first initial potential $V_{ini1}$ that makes the light emitting element in each of the second column of pixel units 801 electrically connected to the data line DL2 not emit light, and so forth.

The second initial potential $V_{ini2}$ makes the first transistor T1 in each pixel unit 801 electrically connected to the data line be turned on. For example, the potential of the data line DL1 is reset, by the reset circuit 60 electrically connected to the data line DL1, to the second initial potential $V_{ini2}$ that makes the first transistor T1 in each of the first column of pixel units 801 electrically connected to the data line DL1 be turned on, and the potential of the data line DL2 is reset, by the reset circuit 60 electrically connected to the data line DL2, to the second initial potential $V_{ini2}$ that makes the first transistor T1 in each of the second column of pixel units 801 electrically connected to the data line DL2 be turned on, and so forth.

In some implementations, for the structure of the reset circuit 60, reference may be, for example, made to the structure of the reset circuit 60 shown in FIG. 4. Each reset circuit 60 may comprise a fifth transistor T5. The control terminal of the fifth transistor T5 is configured to receive the reset signal R, the first terminal of the fifth transistor T5 is electrically connected to a corresponding data line, and the second terminal of the fifth transistor T5 is electrically connected to the third voltage terminal $V_{ini}$.

In some embodiments, the operating voltages of the light emitting elements in the plurality of pixel units may be sensed line by line before the display stage of each display cycle, the light emitting elements in the plurality of pixel units may be driven to emit light line by line in the display stage of each display cycle, and the threshold voltages of the first transistors in the plurality of pixel units may be sensed line by line after the display stage of each display cycle.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features can be made without departing from the scope and spirit of the present disclosure. The scope of the disclosure is defined by the following claims.

What is claimed is:

1. A driving method of a pixel circuit, the pixel circuit comprising:

a light emitting element comprising an anode and a cathode that is electrically connected to a first voltage terminal;

a control circuit electrically connected to the anode of the light emitting element and configured to be turned on or off in response to a control signal from a control line;

a first switching circuit configured to be in a conductive state, in response to a first scan signal from a first scan line, to transmit a voltage from a data line;

a driving circuit configured to drive the light emitting element to emit light under control of the voltage transmitted from the first switching circuit, the driving circuit comprising:

a first transistor, of which a control terminal is electrically connected to the first switching circuit, a first terminal is electrically connected to a second voltage terminal, and a second terminal is electrically connected to the control circuit, and a capacitor, of which a first terminal is electrically connected to the second voltage terminal, and a second terminal is electrically connected to the first switching circuit; and a second switching circuit electrically connected to the data line, the second terminal of the first transistor and the control circuit, and configured to be in a conductive state, in response to a second scan signal from a second scan line, to stabilize a potential of the data line at a first fixed potential or a second fixed potential;

wherein the driving method comprises:

stabilizing, in a first stage, the potential of the data line at the first fixed potential that makes the light emitting element emit light;

stabilizing, in a second stage, the potential of the data line at the second fixed potential that makes the first transistor be turned off, wherein the second stage comprises a third non-display stage and a seventh non-display stage after the third non-display stage, wherein:

in the third non-display stage, the control circuit is turned off in response to the control signal, the second switching circuit is turned on in response to second scan signal to charge the data line, and the first switching circuit is turned on in response to the first scan signal to charge the capacitor by the data line, thereby stabilizing the potential of the data line at the second fixed potential, and in the seventh non-display stage, the first fixed potential is read by a source driver from the data line; and providing, in a display stage, a compensated data voltage to the data line to drive the light emitting dement to emit light, wherein the compensated data voltage is determined according to the first fixed potential and the second fixed potential, wherein the first stage and the second stage are in a non-display stage, and wherein a starting time of the display stage is a time when a display panel, where the pixel circuit is located, starts to display a screen based on the compensated data voltage and an end time of the display stage is a time when the display panel stops displaying the screen.

2. The driving method according to claim 1, wherein the second stage further comprises a fifth non-display stage before the third non-display stage;

in the fifth non-display stage, the potential of the data line is reset to a second initial potential that makes the first transistor be turned on, the control circuit is turned off in response to the control signal, the first switching circuit is turned on in response to the first scan signal, and the second switching circuit is turned on in response to the second scan signal.

3. The driving method according to claim 1, wherein a display cycle is a time period between a startup time of the display panel and a shutdown time of the display panel;

during a same display cycle, the first stage is between the startup time of the display panel and a start time of the display stage, and the second stage is between an end time of the display stage and the shutdown time of the display panel.

4. The driving method according to claim 3, wherein in the display stage, the control circuit is turned on in response to the control signal, the first switching circuit is turned on in response to the first scan signal to transmit the compensated data voltage from the data line to the second terminal of the capacitor and the control terminal of the first transistor, the first transistor is turned on under control of the compensated data voltage to generate a driving current for driving the light emitting element to emit light, and the second switching circuit is turned off in response to the second scan signal; and wherein the compensated data voltage is a sum of a data voltage before compensation, a first compensation voltage, and a second compensation voltage, wherein the first compensation voltage is determined according to a threshold voltage of the first transistor, the second compensation voltage is determined according to an operating voltage of the light emitting element, the threshold voltage of the first transistor is determined according to the second fixed potential of a previous display cycle of a current display cycle, and the operating voltage of the light emitting element is determined according to the first fixed potential of the current display cycle.

5. The driving method according to claim 1, wherein the second switching circuit comprises a second transistor, of which a control terminal is configured to receive the second scan signal, a first terminal is electrically connected to the data line, and a second terminal is electrically connected to the control circuit.

6. The driving method according to claim 1, wherein the data line is electrically connected to a reset circuit, and the potential of the data line is reset by the reset circuit to a first initial potential or a second initial potential, wherein the first initial potential makes the light emitting element not emit light, and the second initial potential makes the first transistor be turned on.

7. The driving method according to claim 1, wherein the control circuit comprises a fourth transistor, of which a control terminal is configured to receive the control signal, a first terminal is electrically connected to the second terminal of the first transistor, and a second terminal is electrically connected to the anode of the light emitting element.

8. The driving method according to claim 1, wherein the first switching circuit comprises a third transistor, of which a control terminal is configured to receive the first scan signal, a first terminal is electrically connected to the data line, and a second terminal is electrically connected to the second terminal of the capacitor and the control terminal of the first transistor.

9. A driving method of a pixel circuit, the pixel circuit comprising:

a light emitting element comprising an anode and a cathode that is electrically connected to a first voltage terminal;

a control circuit electrically connected to the anode of the light emitting element and configured to be turned on or off in response to a control signal from a control line;

a first switching circuit configured to be in a conductive state, in response to a first scan signal from a first scan line, to transmit a voltage from a data line;

a driving circuit configured to drive the light emitting element to emit light under control of the voltage transmitted from the first switching circuit, the driving circuit comprising:

a first transistor, of which a control terminal is electrically connected to the first switching circuit, a first terminal is electrically connected to a second voltage terminal, and a second terminal is electrically connected to the control circuit, and a capacitor, of which a first terminal is electrically connected to the second voltage terminal, and a second terminal is electrically connected to the first switching circuit; and a second switching circuit electrically connected to the data line, the second terminal of the first transistor and the control circuit, and configured to be in a conductive state, in response to a second scan signal from a second scan line, to stabilize a potential of the data line at a first fixed potential or a second fixed potential;

wherein the driving method comprises:

stabilzing, in a first stage, the potential of the data line at the first fixed potential that makes the light emitting element emit light;

stabilizing, in a second stage, the potential of the data line at the second fixed potential that makes the first transistor be turned off; and providing, in a display stage, a compensated data voltage to the data line to drive the light emitting element to emit light, wherein the compensated data voltage is determined according to the first fixed potential and the second fixed potential;

wherein the first stage and the second stage are in a non-display stage, and a starting time of the display stage is a time when a display panel where the pixel circuit is located starts to display a screen based on the compensated data voltage and an end time of the display stage is a time when the display panel stops displaying the screen;

wherein a display cycle is a time period between a startup time of the display panel and a shutdown time of the display panel, and during a same display cycle, the first stage is between the startup time of the display panel and a start time of the display stage, and the second stage is between an end time of the display stage and the shutdown time of the display panel;

wherein, in the display stage, the control circuit is turned on in response to the control signal, the first switching circuit is turned on in response to the first scan signal to transmit the compensated data voltage from the data line to the second terminal of the capacitor and the control terminal of the first transistor, the first transistor is turned on under control of the compensated data voltage to generate a driving current for driving the light emitting element to emit light, and the second switching circuit is turned off in response to the second scan signal; and wherein the compensated data voltage is a sum of a data voltage before compensation, a first compensation voltage, and a second compensation voltage, wherein the first compensation voltage is determined according to a threshold voltage of the first transistor, the second compensation voltage is determined according to an operating voltage of the light emitting element, the threshold voltage of the first transistor is determined according to the second fixed potential of a previous display cycle of a current display cycle, and the operating voltage of the light emitting element is determined according to the first fixed potential of the current display cycle.

* * * * *